US011221007B2

(12) United States Patent
Lee et al.

(10) Patent No.: US 11,221,007 B2
(45) Date of Patent: Jan. 11, 2022

(54) COMPRESSOR INCLUDING ROTATIONAL SHAFT WITH REFRIGERANT FLOW PATH

(71) Applicant: LG ELECTRONICS INC., Seoul (KR)

(72) Inventors: Donggeun Lee, Seoul (KR); Sungchoon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 217 days.

(21) Appl. No.: 16/658,804

(22) Filed: Oct. 21, 2019

(65) Prior Publication Data

US 2021/0003130 A1 Jan. 7, 2021

(30) Foreign Application Priority Data

Jul. 1, 2019 (KR) ..... 10-2019-0078521

(51) Int. Cl.

| | |
|---|---|
| ***F04B 39/02*** | (2006.01) |
| ***F04C 18/02*** | (2006.01) |
| ***F04C 29/06*** | (2006.01) |
| *F04C 23/00* | (2006.01) |
| *F04C 29/02* | (2006.01) |

(52) U.S. Cl.

CPC ..... *F04C 18/0215* (2013.01); *F04B 39/0246* (2013.01); *F04C 23/008* (2013.01); *F04C 29/028* (2013.01); *F04C 2240/603* (2013.01); *F04C 2240/806* (2013.01)

(58) Field of Classification Search

CPC .. F04C 18/0215; F04C 29/023; F04C 29/065; F04C 29/068; F04C 2240/603; F04B 39/0246

USPC ..... 418/188

See application file for complete search history.

(56) References Cited

U.S. PATENT DOCUMENTS

| | | | | |
|---|---|---|---|---|
| 4,781,542 A * | 11/1988 | Ozu et al. | ..... | F04B 39/0246 418/188 |
| 4,867,657 A | 9/1989 | Kotlarek et al. | | |
| 5,129,798 A | 7/1992 | Crum et al. | | |

FOREIGN PATENT DOCUMENTS

| | | | | |
|---|---|---|---|---|
| GB | 2 223 808 | 4/1990 | | |
| JP | 57-18491 | 1/1982 | | |
| JP | 61008492 A * | 1/1986 | ..... | F04C 29/045 |
| JP | 3-194180 | 8/1991 | | |
| JP | 04060188 A * | 2/1992 | ..... | F04C 27/005 |
| JP | H05-001678 | 1/1993 | | |
| KR | 10-2011-0131744 | 12/2011 | | |
| KR | 10-2016-0020190 | 2/2016 | | |
| KR | 10-2018-0031390 | 3/2018 | | |
| KR | 10-2018-0083646 | 7/2018 | | |
| KR | 10-2018-0086749 | 8/2018 | | |

(Continued)

OTHER PUBLICATIONS

English translatoin of JP 04060188 by J Piat Pat Jun. 3, 2021.*

(Continued)

*Primary Examiner* — Deming Wan

(74) *Attorney, Agent, or Firm* — Ked & Associates LLP

(57) ABSTRACT

A compressor is provided that may include a refrigerant flow path provided in a rotational shaft so as to guide a refrigerant gas. The rotational shaft operates a compression device using a drive force of an electric motor. In such a structure, the refrigerant gas may be directly discharged to a discharge space without passing through other portions such that flow path resistance may be minimized.

21 Claims, 17 Drawing Sheets

(56) References Cited

FOREIGN PATENT DOCUMENTS

| | | |
|---|---|---|
| KR | 10-2019-0001070 | 1/2019 |
| WO | WO 97/35112 | 9/2017 |

OTHER PUBLICATIONS

European Search report dated Dec. 12, 2019.
Korean Office Action dated Aug. 11, 2020 issued in KR Application No. 10-2019-0078521.

* cited by examiner

COMPRESSOR INCLUDING ROTATIONAL SHAFT WITH REFRIGERANT FLOW PATH

CROSS-REFERENCE TO RELATED APPLICATION(S)

The present application claims priority to Korean Patent Application No. 10-2019-0078521, filed in Korea on Jul. 1, 2019, the entire contents of which is incorporated herein for all purposes by this reference.

BACKGROUND

1. Field

A compressor is disclosed herein.

2. Background

Generally, a compressor is a mechanical device used for producing high pressure or transferring a high-pressure fluid. The compressor may be applied to a refrigeration cycle of a refrigerator or an air conditioner, for example, and compresses a refrigerant and transfers the compressed refrigerant to a condenser. Compressors are typically classified into a reciprocating compressor, a rotary compressor, or a scroll compressor according to a method of compressing a gas refrigerant.

The scroll compressor includes a fixed scroll fixed in an inner space of a sealed container and an orbiting scroll engaged with the fixed scroll to perform an orbiting movement, whereby suction, gradual compression, and discharge of a refrigerant are continuously and repetitively performed by a compression chamber continuously defined between a fixed wrap of the fixed scroll and an orbiting wrap of the orbiting scroll.

The scroll compressor includes a compression device composed of the fixed scroll and the orbiting scroll and an electric motor that generates a rotational drive force to rotate the orbiting scroll. Scroll compressors may be divided into upper compression type compressors and lower compression type compressors depending on a position of the electric motor. In addition, scroll compressors may be divided into low pressure compressors and high pressure compressors depending on a supply position of the refrigerant gas.

In the lower compression type compressor, the compression device is positioned in a lower space of an inner space of a hermetic casing and the electric motor is positioned in an upper space of the inner space of the hermetic casing. However, in the upper compression type compressor, the compression device is positioned in the upper space of the inner space of the hermetic casing and the electric motor is positioned in the lower space of the inner space of the hermetic casing.

In addition, in the low pressure compressor, the refrigerant gas is supplied to the inner space of the hermetic casing and then is indirectly supplied to the compression device, but in the high pressure compressor, the refrigerant gas is directly supplied to the compression device.

Recently, a lower compression type compressor having a high pressure compressor has been provided. This type of compressor is disclosed in Korean Patent Application Publication No. 10-2016-0020190, Korean Patent Application Publication No. 10-2018-0083646, and Korean Patent Application Publication No. 10-2018-0086749, which are hereby incorporated by reference.

In the lower compression type compressor having the high pressure compressor according to the related art described above, the refrigerant gas compressed in the compression device is discharged into a discharge cover provided in a portion beneath the compression device and then is supplied through multiple refrigerant flow paths formed along circumferences of the fixed scroll and a main frame of the compression device and communicating with each other to a space in which the electric motor is positioned. The refrigerant gas continuously passes through various gaps in the electric motor and flows to the upper space of the inner space of the hermetic casing, and then is discharged through a refrigerant discharge pipe provided in the upper space to the outside.

However, according to the compressor of the related art described above, to form a flow path to guide the compressed refrigerant gas to a discharge space, the main frame and the fixed scroll are required to include the multiple refrigerant flow paths, and each component is required to be accurately installed such that each of the refrigerant flow paths communicates with the components, which caused difficulty in manufacturing. In addition, oil existing in the lower space (a space positioned on or at a lower side of the discharge cover) of the inner space of the hermetic casing is pumped to each of sliding portions during rotation of a rotational shaft. The rotational shaft is required to extend through the discharge cover, and accordingly, a structure for sealing maintenance of this portion, which is formed through the discharge cover, is required to be added, which makes the structure of the discharge cover very complicated.

Further, in a process in which the refrigerant gas discharged into the discharge cover passes through the space in which the electric motor is positioned after passing through the refrigerant flow paths of the fixed scroll and the main frame, the refrigerant gas meets oil flowing down from each of the sliding portions after being pumped thereto. Accordingly, the refrigerant gas doesn't efficiently flow to the upper space of the inner space of the hermetic casing and is discharged through the refrigerant discharge pipe to the outside, with a portion of the oil mixed therewith. To prevent the oil and the refrigerant gas from being discharged to the outside while mixed with each other, a separation guide that separates the oil from the refrigerant gas is required to be further provided between the electric motor and the main frame.

In addition, the compressor of the related art described above, couldn't achieve an improved performance due to an excessive flow path resistance in the process in which the refrigerant gas discharged into the discharge cover passes through the compression device and the electric motor in order.

BRIEF DESCRIPTION OF THE DRAWINGS

Embodiments will be described in detail with reference to the following drawings in which like reference numerals refer to like elements, and wherein.

DETAILED DESCRIPTION

Figure 1:
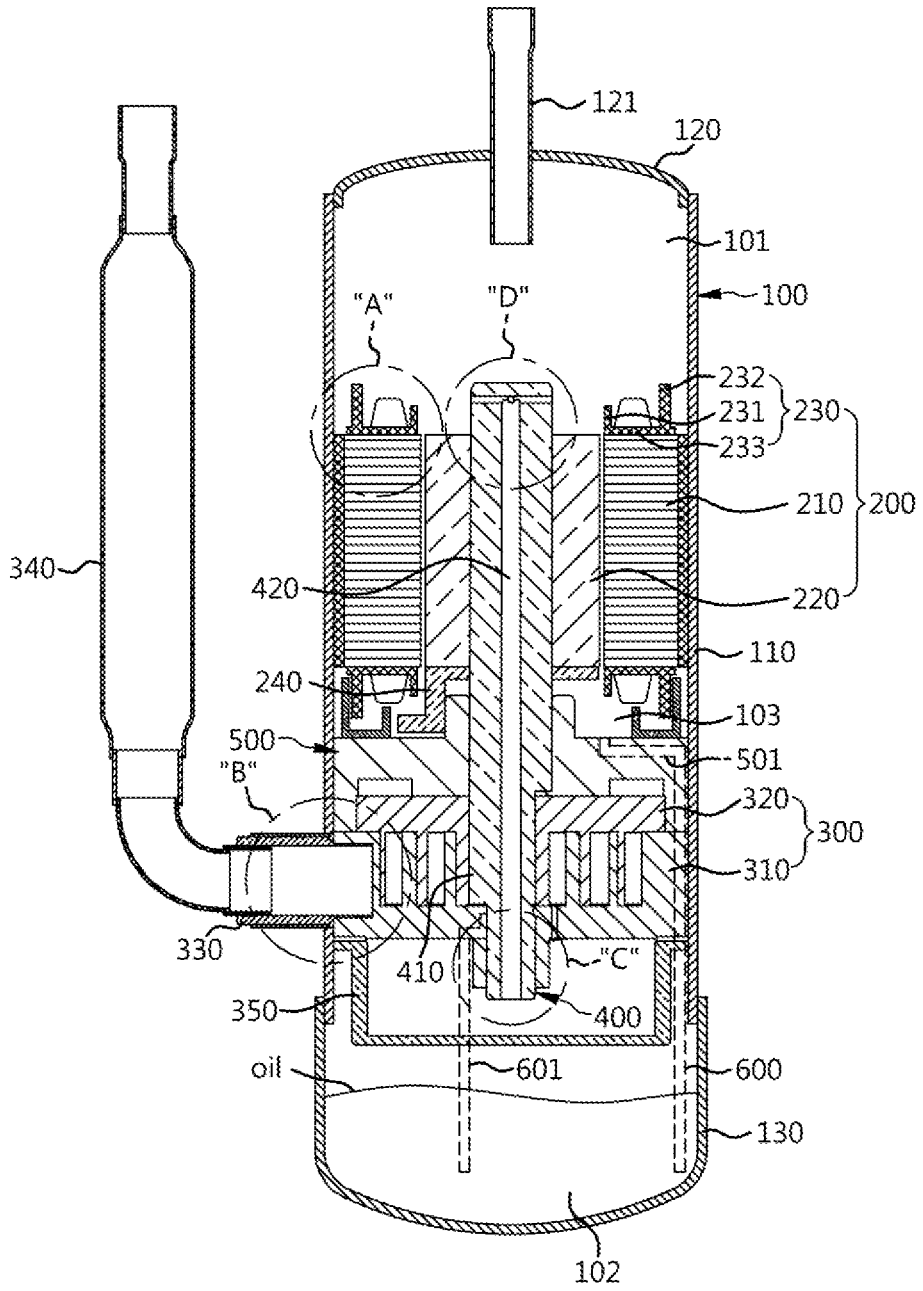
FIG. 1 is a cross-sectional view of a compressor according to an embodiment.

Hereinbelow, embodiments of a compressor will be described with reference to FIGS. 1 to 21. Wherever possible, the same or like reference numerals have been used to indicate the same or like elements, and repetitive disclosure has been omitted.

FIG. 1 is a cross-sectional view of a compressor according to an embodiment. FIGS. 2 to 5 show enlarged views of portions of FIG. 1.

Accordingly, the compressor according to an embodiment may include a hermetic casing 100, an electric motor 200, a compression device 300, and a rotational shaft 400. A refrigerant flow path 420 may be provided in the rotational shaft 400 to prevent refrigerant gas and oil from being mixed with each other and to reduce a flow path resistance of the refrigerant gas, whereby an improved performance thereof may be achieved.

The hermetic casing 100 may form an outer surface of the compressor. The hermetic casing 100 may include a cylindrical body shell 110, an upper end and a lower end of which are open, an upper shell cover 120 that covers the upper end of the body shell 110, and a lower shell cover 130 that covers the lower end of the body shell 110. The body shell 110 may be, for example, welded to the upper shell cover 120 and the lower shell cover 130 to be fixed thereto.

A discharge space 101 may be provided at a highest position in an inner space of the hermetic casing 100 into which the refrigerant gas may be discharged, and an oil storage space 102 may be provided at a lowest side space of the hermetic casing 100 to store oil. A refrigerant discharge pipe 121 may be provided in the upper shell cover 120 of the hermetic casing 100 through which the refrigerant gas in the discharge space 101 may be discharged. The refrigerant discharge pipe 121 may be connected to a condenser of a refrigeration cycle (not shown) so as to transfer the refrigerant gas thereto.

The refrigerant discharge pipe 121 may protrude into an inner space of the discharge space 101 by extending through a center of an upper surface of the upper shell cover 120. Alternatively, the refrigerant discharge pipe 121 may extend through a portion of the upper shell 120 other than the center of the upper surface of the upper shell cover 120.

The electric motor 200 supplies a rotational drive force. Such an electric motor 200 may be positioned at a lower portion of the discharge space 101 in the hermetic casing 100.

The electric motor 200 may include a stator 210 fixed at or to an inner circumference of the hermetic casing 100 and a rotor 220 rotatably provided in the stator 210. The stator 210 may include stator cores 211 (see FIG. 2), which are multiply laminated, and a coil 212 (see FIG. 2) wound on the stator cores 211. A motor insulator 230 may be provided on an upper side and a lower side of the laminated stator cores 211 to wind and insulate the coil 212.

Figure 2:
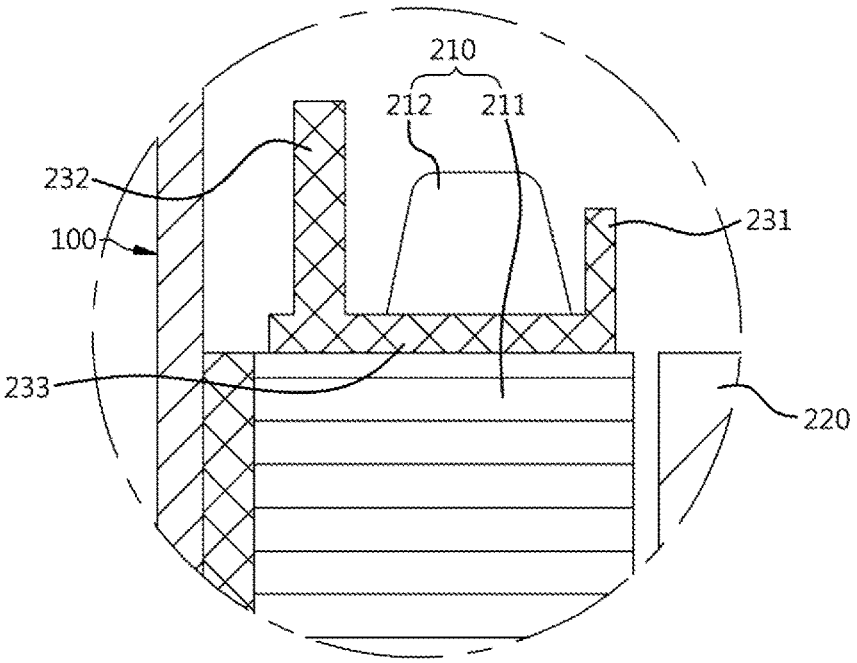
FIG. 2 is an enlarged view of portion "A" of FIG. 1.

The motor insulator 230 may include an inner partition wall 231, an outer partition wall 232 spaced apart from the inner partition wall 231, and a connecting wall 233 that connects the two partition walls. A height of the inner partition wall 231 may be lower than a height of the outer partition wall 232. This is shown in FIG. 2. The rotor 220 may be a hollow magnet, which may be roughly cylinder-shaped, and may be rotatably provided in the stator 210.

A balance weight 240 may be provided on or at a lower surface of the rotor 220. Accordingly, although the rotational shaft 400 includes an eccentric portion 410, the rotor 220 may rotate stably.

Hereinafter, compression device 300 which compresses the refrigerant gas will be discussed.

The compression device 300 may be positioned on or at a lower side of the electric motor 200 in the lower side space in the hermetic casing 100. The compression device 300 may include a fixed scroll 310 fixed to the inner circumference of the hermetic casing 100 and having a fixed wrap 311; and an orbiting scroll 320 having an orbiting wrap 321 engaged with the fixed wrap 311 of the fixed scroll 310 and provided to orbit by receiving a drive force of the rotational shaft 400, which will be described hereinafter. The fixed scroll 310 may be positioned at a lower portion of the compression device 300, and the orbiting scroll 320 may be positioned at an upper portion thereof.

A discharge port 312 may be provided in a lower surface of the fixed scroll 310 such that the refrigerant gas compressed between the fixed wrap 311 and the orbiting wrap 321 may be discharged to a lower space of the inner space of the hermetic casing 100. An opening/closing valve 313 may be provided in the discharge port 312. As described hereinafter, centers of the fixed scroll 310 and the orbiting scroll 320 may be open so that the rotational shaft 400 may extend through the centers.

Figure 3:
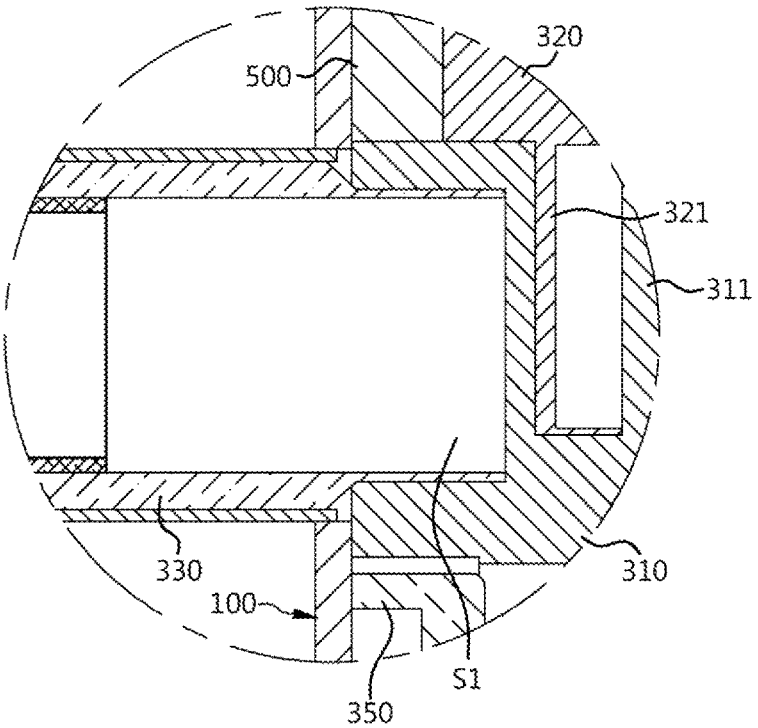
FIG. 3 is an enlarged view of portion "B" of FIG. 1.

A refrigerant introduction pipe 330 may be connected to a circumference of the fixed scroll 310 to communicate therewith. The refrigerant introduction pipe 330 extends through a circumferential wall of the hermetic casing 100. In addition, the refrigerant introduction pipe 330 may be connected to the accumulator 340 so as to receive the refrigerant gas therefrom. That is, the refrigerant gas introduced through the accumulator 340 to the refrigerant introduction pipe 330 may be introduced to a space (a compression chamber) S1 between the fixed scroll 310 and the orbiting scroll 320. This is shown in FIG. 3.

A main frame 500 may be provided between the compression device 300 and the electric motor 200. The main frame 500 may support operations of the orbiting scroll 320 and the rotational shaft 400 and may support the electric motor 200.

The rotational shaft 400 may operate, that is rotate, the orbiting scroll 320 of the compression device 300 using the rotational drive force of the electric motor 200. The rotational shaft 400 may extend through centers of the electric motor 200 and the compression device 300 such that an upper end of the rotational shaft 400 is exposed in the discharge space 101 and a lower end thereof is exposed to a space beneath the compression device 300.

A portion of the rotational shaft 400 formed through the electric motor 200 may be coupled with the rotor 220 of the electric motor 200 so as to receive a rotational force of the rotor 220, and a portion of the rotational shaft 400 formed through the orbiting scroll 320 may be coupled (for example, spline coupling) with the orbiting scroll 320 so as to transmit power thereto. In this case, the portion of the rotational shaft 400 coupled with the orbiting scroll 320 may include eccentric end 410 (see FIG. 1) eccentric to other portions. The eccentric end 410 allows the orbiting scroll 320 to orbit relative to the fixed scroll 310.

The rotational shaft 400 may include the refrigerant flow path 420 that guides the refrigerant gas compressed by the compression device 300 to the discharge space 101. The refrigerant flow path 420 may extend in the rotational shaft 400 from an upper end thereof to a lower end thereof. The upper end and the lower end may communicate with the discharge space 101 in the hermetic casing 100 and the space beneath the compression device 300, respectively.

A discharge cover 350 may be provided under the compression device 300 in the hermetic casing 100, and the refrigerant flow path 420 formed in the rotational shaft 400 may communicate with an inner space of the discharge cover 350. The discharge cover 350 may provide a storage space such that the refrigerant gas discharged through the discharge port 312 after the refrigerant gas is compressed in the compression device 300 may be temporarily stored, and function to prevent the refrigerant gas from contacting oil in the oil storage space 102. That is, when the lowest side space in the hermetic casing 100 is the oil storage space 102 that stores oil, the discharge cover 350 may be provided at a portion to which a refrigerant gas of the compression device 300 is discharged, the discharge cover 350 providing a space partitioned from the oil storage space 102, whereby the oil may be prevented from being contained in the compressed refrigerant gas.

Figure 4:
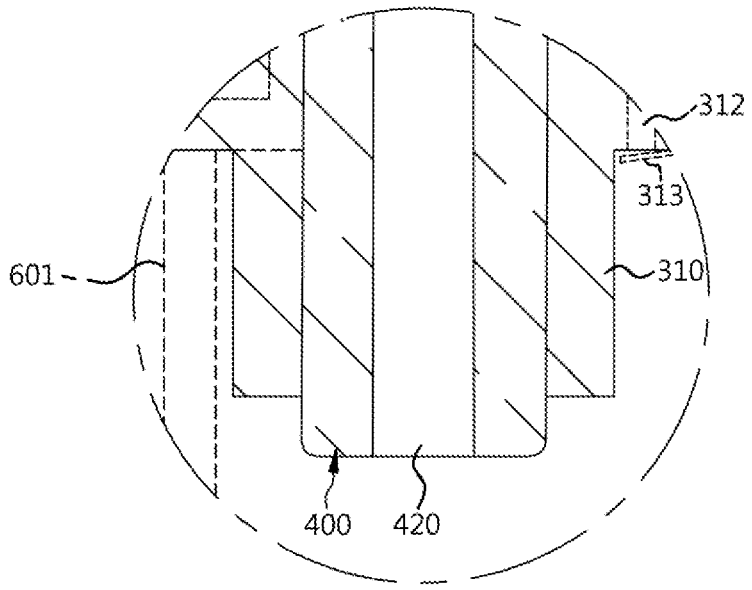
FIG. 4 is an enlarged view of portion "C" of FIG. 1.

More particularly, the refrigerant flow path 420 formed in the rotational shaft 400 may be provided at a position at which the refrigerant flow path 420 does not face the discharge port 312. In one embodiment, a lower end of the rotational shaft 400 is positioned in the discharge cover 350 and the refrigerant flow path 420 is provided to be open at a lower surface of the rotational shaft 400. That is, when the refrigerant gas discharged through the discharge port 312 contains a portion of oil existing in the compression device 300, the oil contained in the refrigerant gas may be prevented from being directly introduced to the refrigerant flow path 420. This is shown in FIG. 4.

Figure 5:
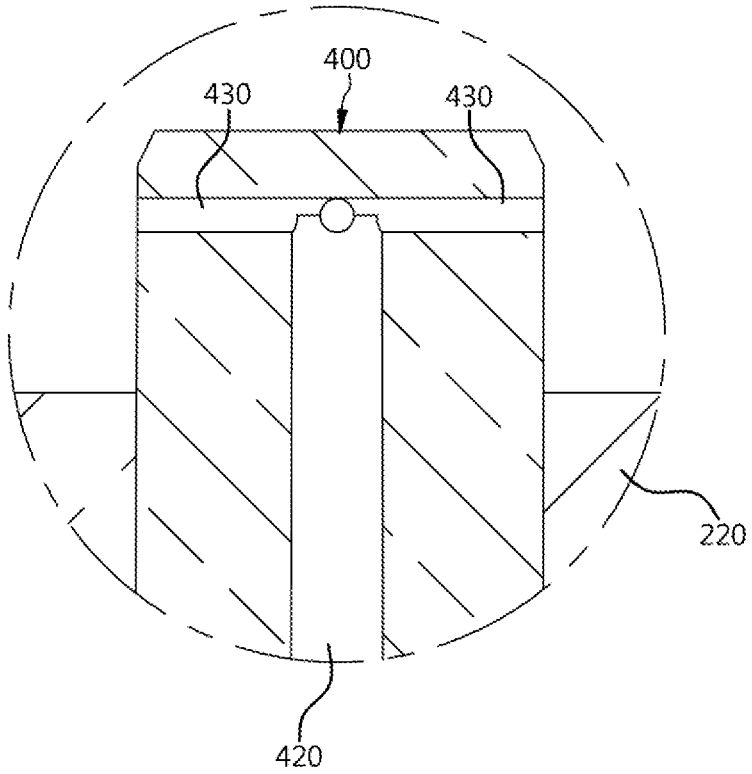
FIG. 5 is an enlarged view of portion "D" of FIG. 1.

A communication flow path 430 may be provided on or at a circumference of the upper end of the rotational shaft 400, the communication flow path communicating with the refrigerant flow path 420 formed in at inner space of the rotational shaft 400 and discharging the refrigerant gas. That is, as the refrigerant discharge pipe 121 is vertically provided by and extends through the center of the upper shell 120, the refrigerant gas flowing along the refrigerant flow path 400 and even oil mixed with the refrigerant gas may be discharged through the refrigerant discharge pipe 121 when the refrigerant flow path 420 formed in the rotational shaft 400 is open to an upper surface of the rotational shaft 400. Accordingly, the communication flow path 430 may be further provided such that the refrigerant flow path 420 does not face the refrigerant discharge pipe 121. This is shown in FIG. 5.

Figure 6:
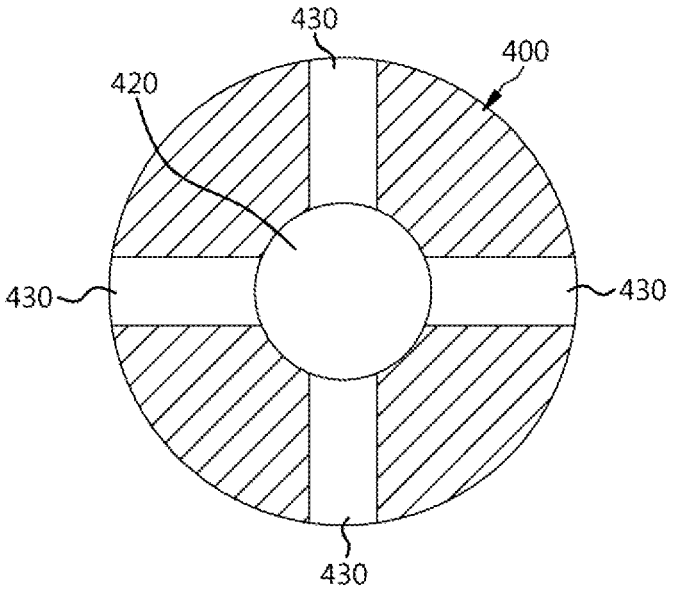
FIGS. 6 to 9 are top plan views illustrating various embodiments of a communication flow path of the compressor according to an embodiment.

The communication flow path 430 may have at least two communication flow paths and each of the communication flow paths may extend in a radial direction from the refrigerant flow path 420 to communicate therewith. This structure ensures that the refrigerant gas may be evenly discharged to an entire portion of the discharge space 101. This is shown in FIG. 6.

Figure 7:
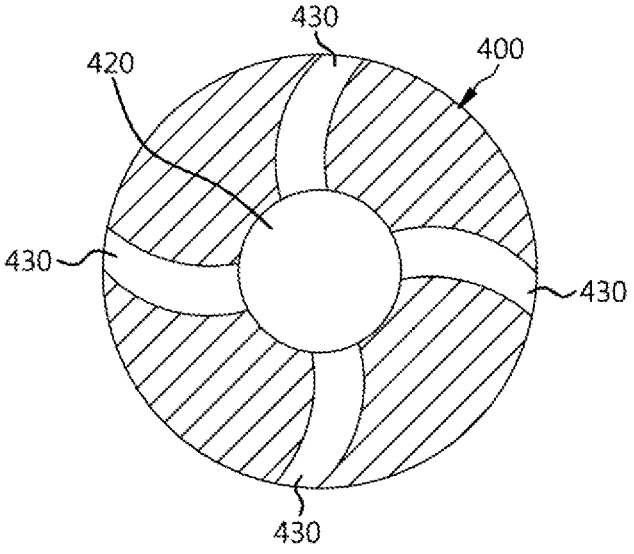
Figure 8:
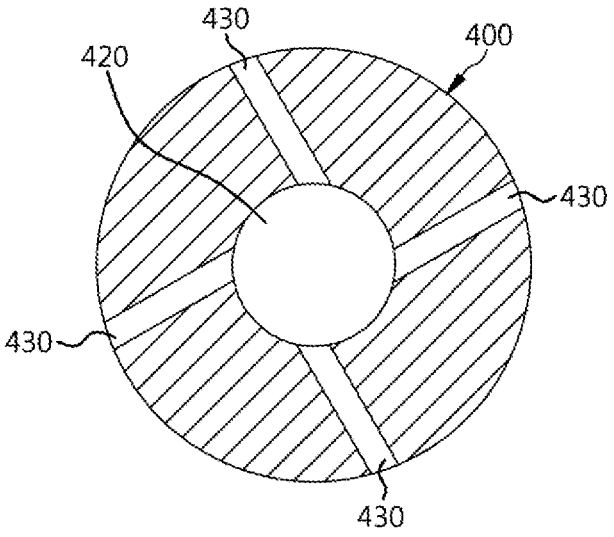
Figure 9:
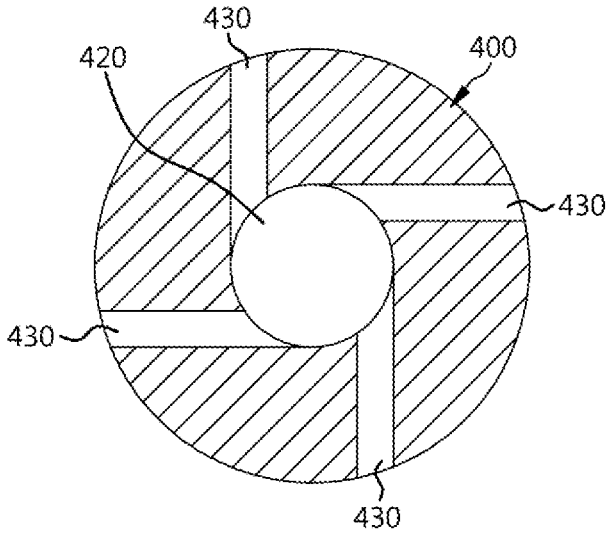

Alternatively, as shown in FIG. 7, the communication flow path 430 may be rounded. As shown in FIG. 8, the communication flow path 430 may be slanted from the refrigerant flow path 420. Further, as shown in FIG. 9, the communication flow path 430 may extend in a tangential direction from the refrigerant flow path 420. In each embodiment, a circulation force is applied to the refrigerant gas passing through the communication flow path 430. Accordingly, while the refrigerant gas circulates in the discharge space of the hermetic casing 100, oil may be separated from the refrigerant gas by a centrifugal force.

The upper end of the rotational shaft 400 may protrude to a height higher than a height of the inner partition wall 231 of the motor insulator 230 of the electric motor 200 (see FIG. 1), and the communication flow paths 430 may be positioned to be higher than the inner partition wall 231. This ensures that the refrigerant gas passes through each of the communication flow paths 430 and is efficiently discharged into the discharge space 101 without hitting the inner partition wall 231.

An oil flow path 600 may be provided in the hermetic casing 100. The oil flow path 600 allows the oil in the oil storage space 102 to be supplied to sliding portions.

The sliding portions in the hermetic casing may include at least any one portion of an operation portion of the compression device 300, a portion of the compression 300 through which the rotational shaft 400 is formed or extends, and a portion between the compression device 300 and the electric motor 200. A lower end of the oil flow path 600 may be immersed in the oil in the oil storage space 102 and an upper end of the oil flow path 600 may extend to an inner space of the main frame 500 by extending through the compression device 300 so as to communicate with the main frame 500. A communicating hole 501 may be provided in the main frame 500. The communicating hole 501 may be connected to the oil flow path 600 such that the oil flow path 600 communicates with the main frame 500.

Figure 10:
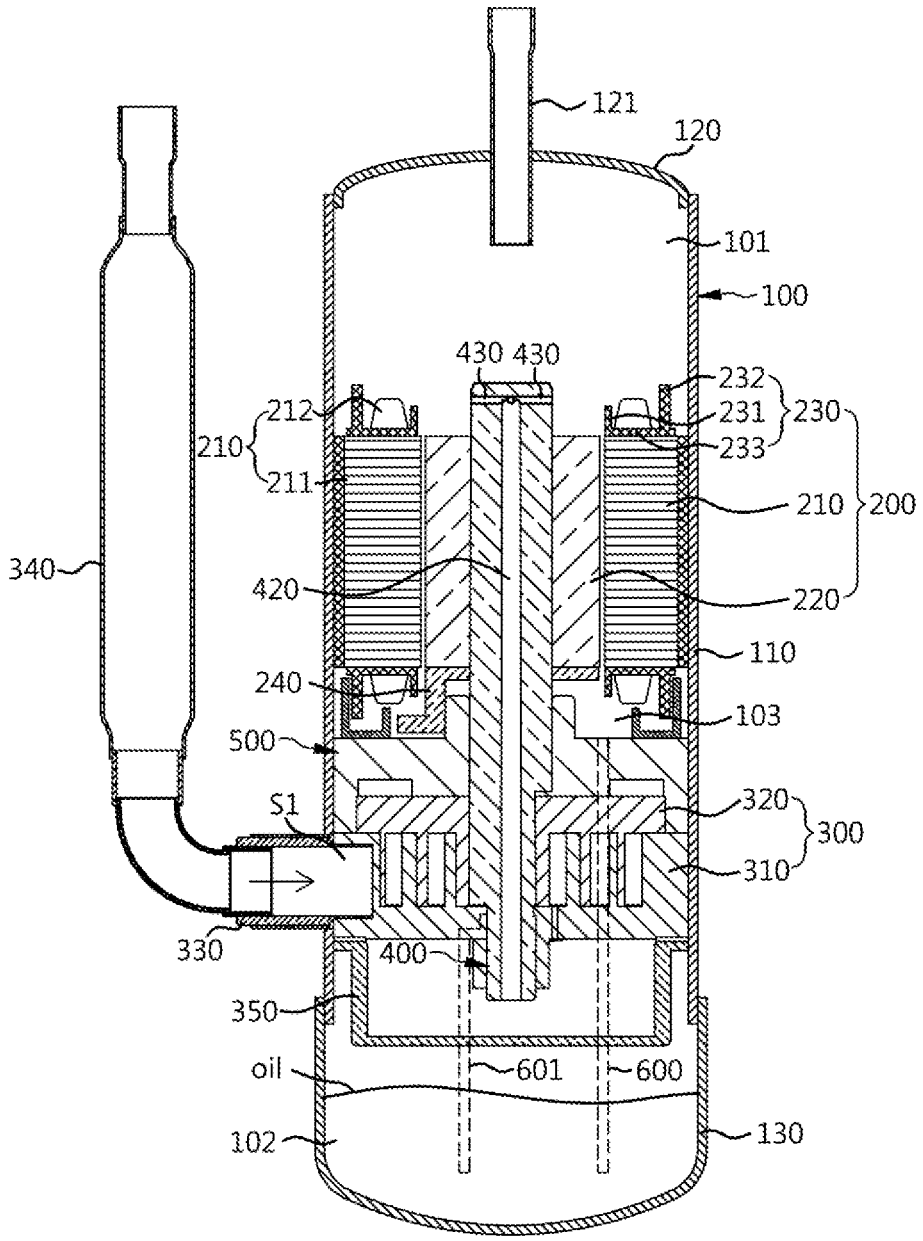
FIG. 10 is a view illustrating another embodiment of a refrigerant flow path of the compressor according to the an embodiment.

The communicating hole 501 may be provided such that oil suctioned along the oil flow path 600 may be suppled to space 103 (hereinbelow, referred to as a "normal pressure space") positioned between the compression device 300 and the electric motor 200. The normal pressure space 103 has a pressure higher than a pressure of the oil storage space 102 due to the influence of high pressure of the discharge space 101 in the hermetic casing 100 and is a space having an average pressure lower than the pressure of the discharge space 101. Accordingly, oil stored in the oil storage space 102 may be supplied into the normal pressure space 103 by being suctioned along the oil flow path 600 and be supplied to each of the sliding portions. As shown in FIG. 10, the oil flow path 600 may directly communicate with the normal pressure space 103 by extending through the compression device 300 and the main frame 500 in order.

Reference numeral 601, which is not described, refers to an auxiliary oil flow path. The auxiliary oil flow path guides the oil in the oil storage space 102 such that the oil is supplied to a sliding portion between the rotational shaft 400 and the fixed scroll 310 (see FIG. 15).

Hereinbelow, operation of the compressor according to the embodiment described above will be described further with reference to FIGS. 11 to 14.

When operation of the compressor is started, power is supplied to the electric motor 200, and the rotor 220 of the electric motor 200 rotates. When the rotor 220 rotates, the rotational shaft 400 which extends through the center of the rotor 220 also rotates together with the rotor 220.

Figure 11:
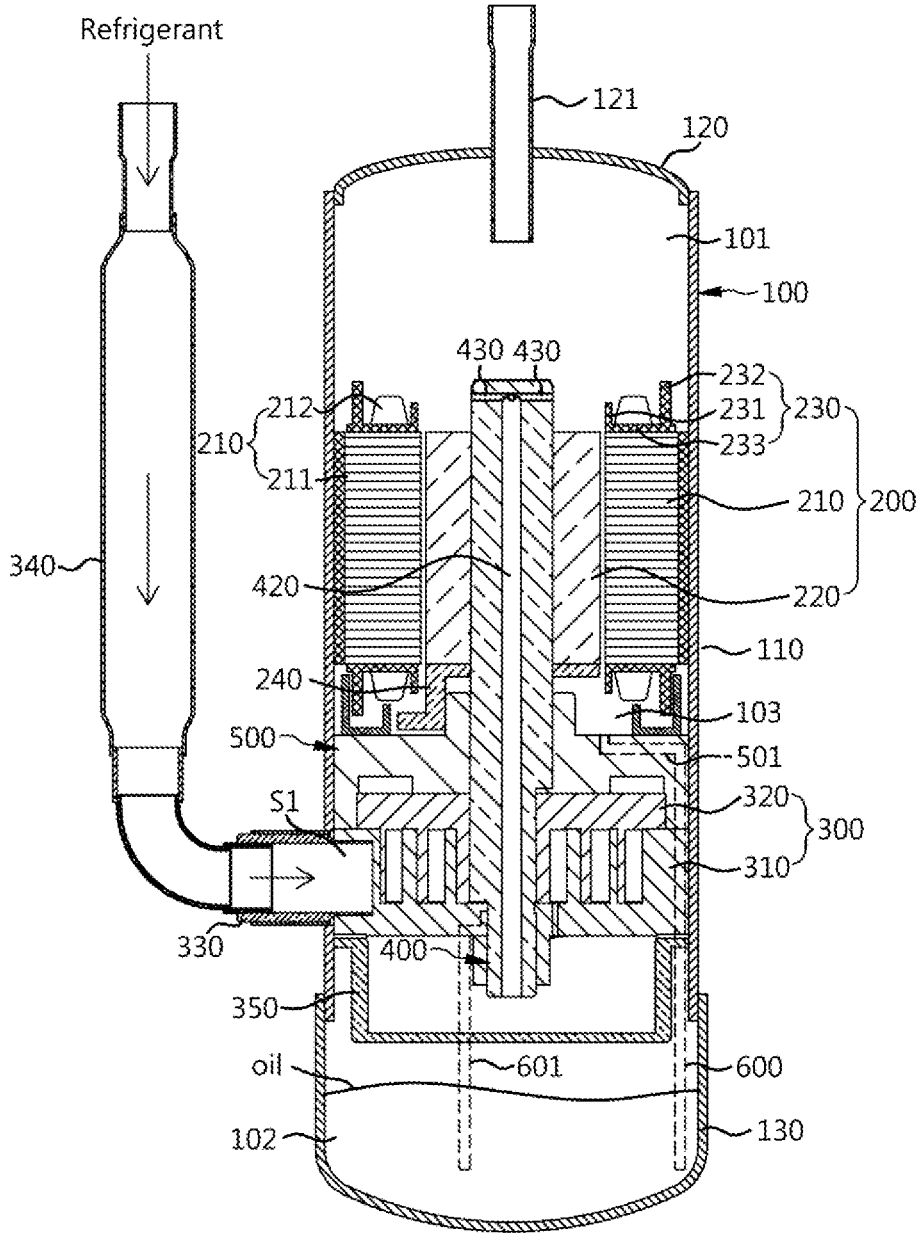
FIGS. 11 to 14 are views illustrating a refrigerant flow process during operation of the compressor according to an embodiment.

Further, when the rotational shaft 400 rotates, the compression device 300 operates and compresses the refrigerant gas in the compression chamber S1. That is, when the rotational shaft 400 rotates, the orbiting scroll 320 eccentrically coupled with the lower end of the rotational shaft 400 orbits relative to a center of the rotational shaft 400. In this process, while any one outer surface of the involute orbiting wrap 321 formed in the orbiting scroll 320 gradually moves along an inner surface of the involute fixed wrap 311 formed in the fixed scroll 310, the compression chamber S1 is continuously defined, so that the refrigerant gas suctioned into the compression chamber S1 is gradually compressed. This is shown in FIG. 11.

When the refrigerant gas is compressed in the compression chamber between the fixed wrap 311 and the orbiting wrap 321, refrigerant gas is introduced to the refrigerant introduction pipe 330 connected to the fixed scroll 310. Due to a pressure difference between the accumulator 340 and the compression chamber S1 caused by pressure produced in an inner space of the fixed scroll 310, the refrigerant gas is forcibly suctioned into the compression chamber S1 from the accumulator 340, and flows along the compression chamber S1 continuously defined between the fixed wrap 311 and the orbiting wrap 321 by a continuous orbiting movement of the orbiting scroll 320 and is gradually compressed.

Figure 12:
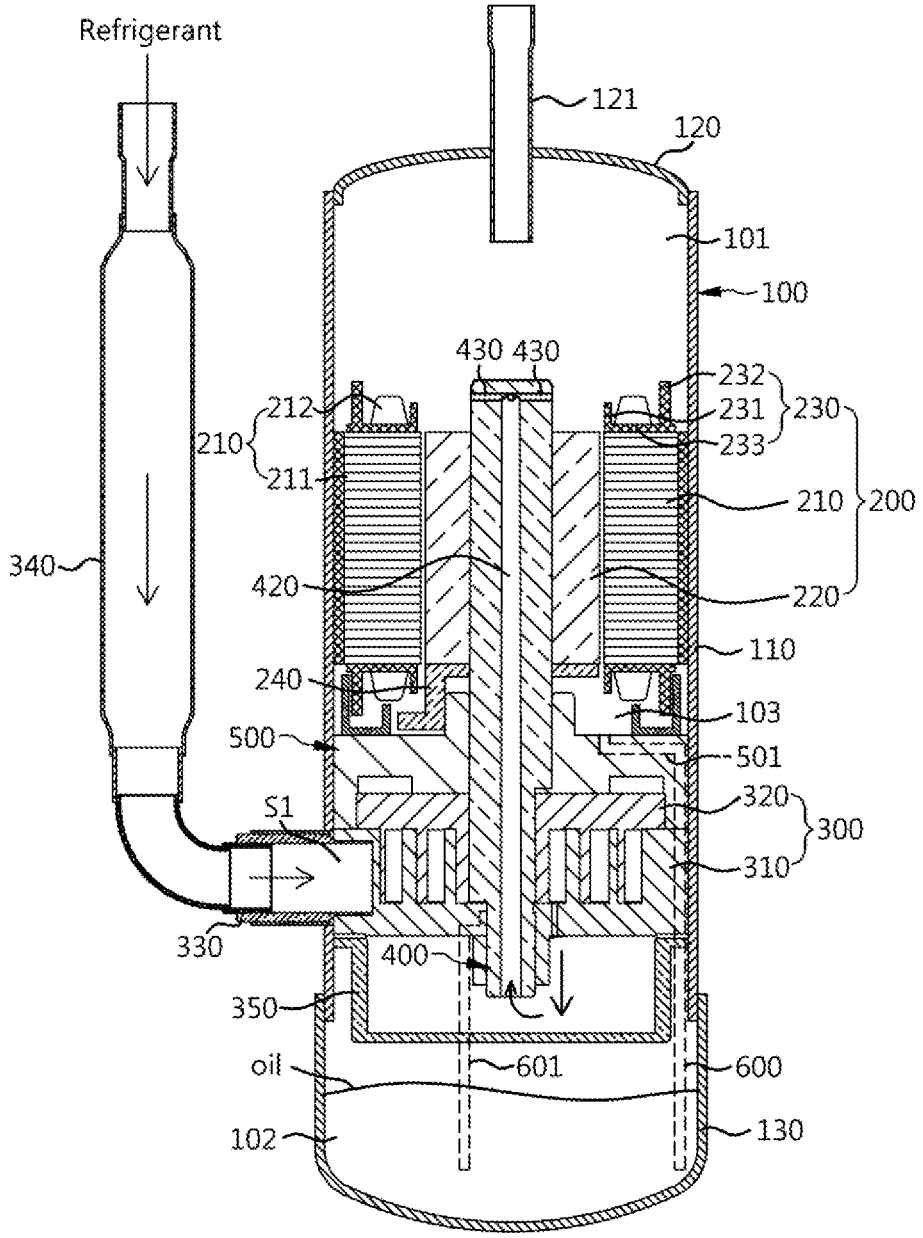

The refrigerant gas is discharged through the discharge port 312 of the fixed scroll 310 to the portion positioned beneath the compression device 300. The discharge cover 350 is provided at the portion positioned beneath the compression device 300, and accordingly, the refrigerant gas discharged through the discharge port 312 is stored in the discharge cover 350. This is shown in FIG. 12.

The refrigerant gas discharged into the discharge cover 350 is introduced into the refrigerant flow path 420 formed in the rotational shaft 400. The refrigerant flow path 420 is provided at a position at which the refrigerant flow path 420 does not face the discharge port 312. Accordingly, although the refrigerant gas is mixed with oil in the process of passing through the compression device 300, the oil is prevented from being directly introduced through the discharge port 312 into the refrigerant flow path 420.

Figure 13:
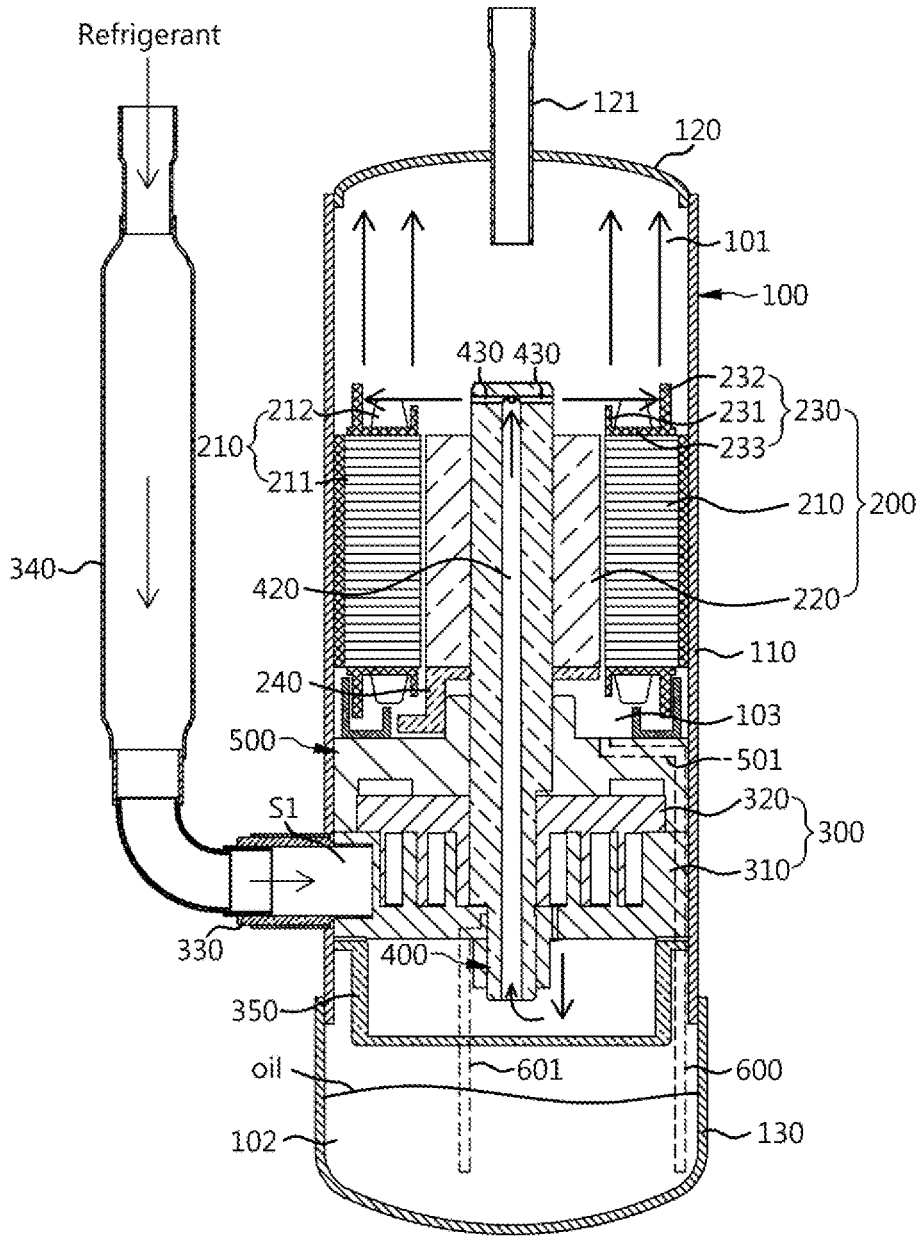

Accordingly, the refrigerant gas flowing along the refrigerant flow path 420 is discharged to the discharge space 101 in the hermetic casing 100. This is shown in FIG. 13.

Figure 14:
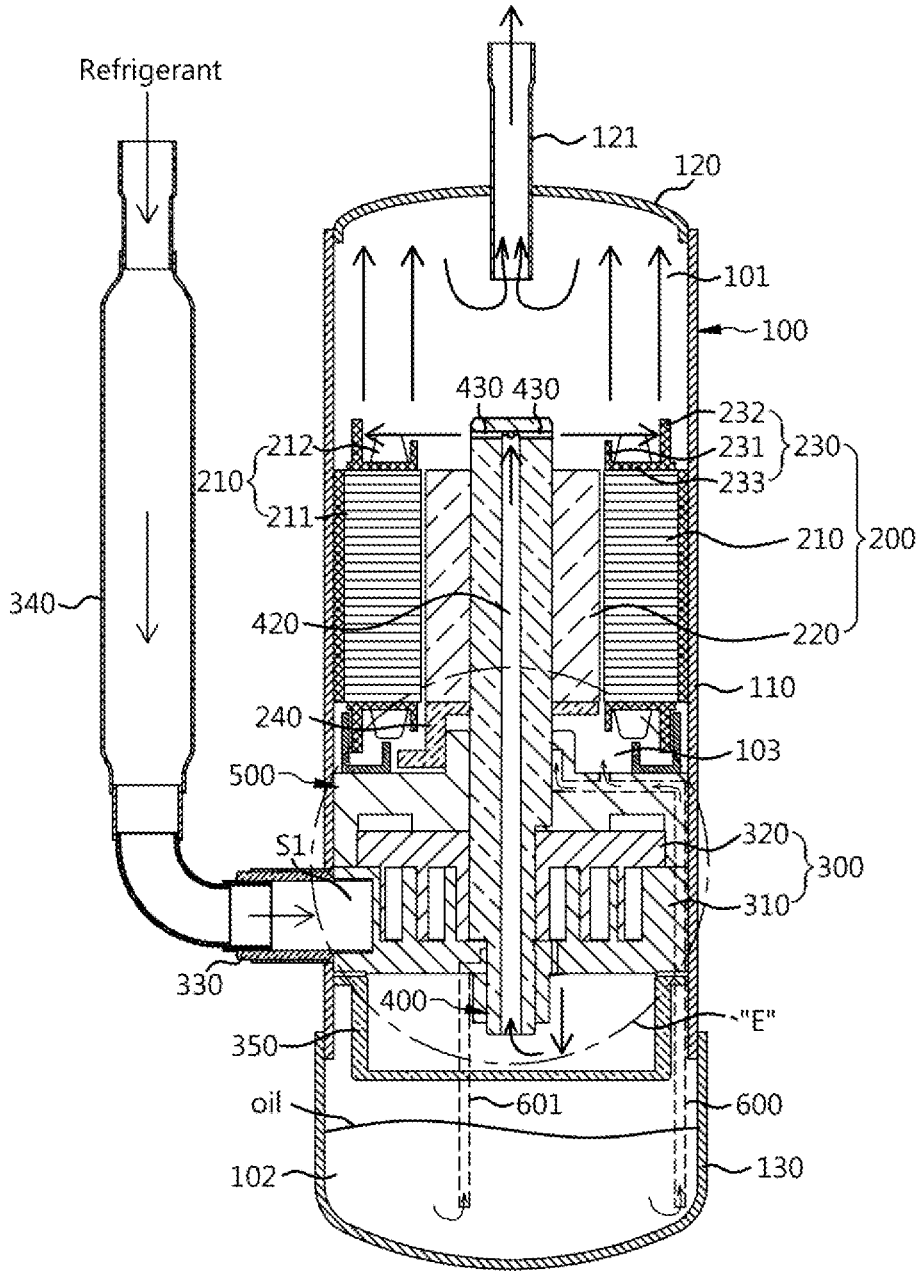

The refrigerant gas is discharged through the plurality of communication flow paths 430 communicating with the upper end of the refrigerant flow path 420 to the discharge space 101. When the refrigerant gas discharged into the discharge space 101 hits an inner circumferential surface of the hermetic casing 100, oil contained in the refrigerant gas is separated from the refrigerant gas, and only the refrigerant gas separated from the oil is discharged through the refrigerant discharge pipe 121. This is shown in FIG. 14.

When the communication flow path 430 is rounded, slanted, or extends in the tangential direction from the refrigerant flow path 420, a circulation force is applied to the refrigerant gas in the process of the refrigerant gas passing through the communication flow path 430. Accordingly, as the refrigerant gas circulates while flowing up an inner wall surface of the hermetic casing 10, oil may be efficiently separated from the refrigerant gas by the centrifugal force.

As described above, while the refrigerant gas is compressed, the normal pressure space 103 between the electric motor 200 and the main frame 500 in the hermetic casing 100 communicates with the discharge space 101 and the oil storage space 102. Accordingly, the normal pressure space 103 has a relatively high pressure compared to the oil storage space 102 and has a relatively low pressure compared to the discharge space 101.

Accordingly, the oil stored in the oil storage space 102 is suctioned along the oil flow path 420 due to the pressure difference between the oil storage space 102 and the normal pressure space 103 and discharged into the normal pressure space 103. The discharged oil is supplied to each of the sliding portions while flowing through each of gaps in the hermetic casing 100. In this case, the sliding portions may include a contact portion of the main frame 500 with the rotational shaft 400, a contact portion of the orbiting scroll 320 with the fixed scroll 310, and a contact portion of the rotational shaft 400 with the fixed scroll 310. The oil supplied to the sliding portions flows down to the oil storage space 102 through gaps between the main frame 500, the compression device 300, and the discharge cover 350, through gaps existing between each of the components (the main frame, the compression device, and the discharge cover) and the hermetic casing 100, or through oil discharge holes (not shown) formed on or at edges of each of the components (the main frame, the compression device, and the discharge cover) and is stored in the oil storage space 102.

Finally, in the compressor according to embodiments disclosed herein, as the refrigerant flow path 420 guiding the refrigerant gas is provided in the rotational shaft 400 operating the compression device 300 using the drive force of the electric motor 200, the refrigerant gas may be directly discharged to the discharge space 101 without passing through other portions, whereby flow path resistance thereof may be minimized. In addition, the compressor according to embodiments disclosed herein may further include the discharge cover 350 providing the storage space to allow the refrigerant gas, which is compressed in the compression device 300, to be discharged to the space beneath the compression device 300 to be stored. The refrigerant flow path 420 formed in the rotational shaft 400 may communicate with the inner space of the discharge cover 350. Accordingly, the oil in the oil storage space 102 may be prevented from being mixed with the compressed refrigerant gas.

In addition, in the compressor according to embodiments disclosed herein, as the refrigerant flow path 420 formed in the rotational shaft 400 is provided at a position at which the refrigerant flow path 420 does not face the discharge port 312 formed in the compression device 300, the oil contained in the refrigerant gas discharged through the discharge port 312 may be prevented from being directly introduced to the refrigerant flow path 420, together with the refrigerant gas.

Further, in the compressor according to embodiments disclosed herein, as the lower end of the rotational shaft 400 is positioned in the discharge cover 350 and the refrigerant flow path 420 is open to the lower surface of the rotational shaft 400, the oil contained in the refrigerant gas discharged through the discharge port 312 may be prevented from being directly introduced to the refrigerant flow path 420 together with the refrigerant gas.

Furthermore, in the compressor according to embodiments disclosed herein, the communication flow path 430 is further provided in the refrigerant flow path 420 of the rotational shaft 400. Accordingly, the refrigerant gas discharged to the discharge space 101 after passing through the refrigerant flow path 420 may be prevented from being directly discharged to the refrigerant discharge pipe 121. Accordingly, the oil contained in the refrigerant gas may be prevented from being directly discharged through the refrigerant discharge pipe 121, together with the refrigerant gas.

In addition, in the compressor according to embodiments disclosed herein, the communication flow path 430 may include the at least two communication flow paths provided in a radial direction from the refrigerant flow path 420 to communicate with the refrigerant flow path 420, whereby the refrigerant gas may be discharged to the inner circumferential wall surface of the hermetic casing 100. Accordingly, the oil contained in the refrigerant gas may be prevented from being directly discharged through the refrigerant discharge pipe 121, together with the refrigerant gas.

Also, in the compressor according to embodiments disclosed herein, as the oil flow path 600 is further provided in the hermetic casing 100, the oil in the oil storage space 102 may be supplied to the sliding portions.

Additionally, in the compressor according to embodiments disclosed herein, the oil flow path 600 may be provided as a pipe, the lower end of which is positioned to be immersed in the oil in the oil storage space 102 and the upper end of which extends through the compression device 300, whereby as the refrigerant flow path 420 is provided along the inner space of the rotational shaft 400, oil supplied through the oil flow path 600 may be prevented from being mixed with the refrigerant gas flowing along the refrigerant flow path 420.

In addition, according to the compressor according to embodiments disclosed herein, as the refrigerant flow path 420 is formed along the inner space of the rotational shaft 400, an additional member for separating oil and the refrigerant gas from each other is not required to be provided between the electric motor 200 and the main frame 500.

The compressor according to embodiments disclosed herein is not limited to the structure of the embodiments described above. That is, the compressor according to embodiments disclosed herein may be embodied in many different forms.

Example of further embodiments will be discussed hereinafter.

Figure 15:
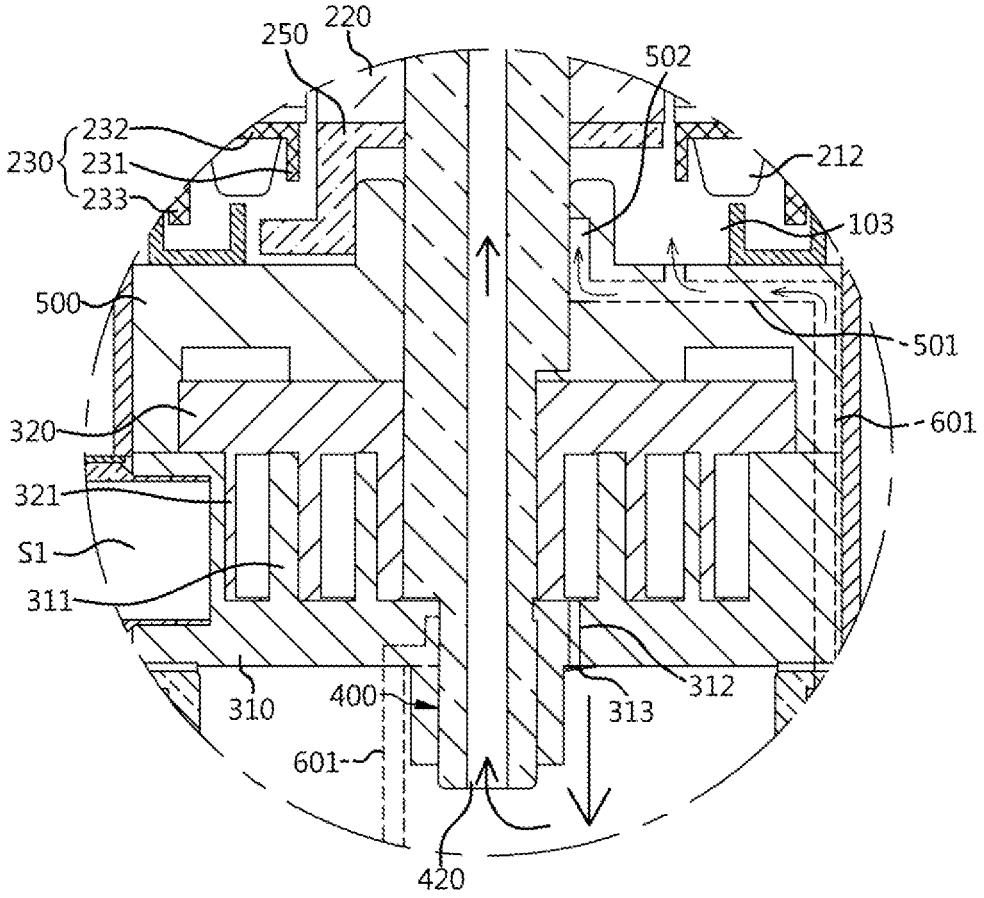
FIG. 15 is an enlarged view of portion "E" of FIG. 14.

The communicating hole 501 in the main frame 500 of the compressor may not be provided such that oil may be suppled only to the normal pressure space 103 but also an oil flow may be guided to a contact portion of the main frame 500 with the rotational shaft 400, which is an inner circumferential surface of the main frame 500. That is, as shown in FIG. 15, an auxiliary flow path 502 may be provided in the main frame 500. The auxiliary flow path 502 may communicate with the oil flow path 600 and guide oil to the contact portion of the main frame 500 with the rotational shaft 400. Accordingly, the oil in the oil storage space 102 may be supplied not only to the contact portion of the rotational shaft 400 with the main frame 500, but also to a contact portion of the rotational shaft 400 with the orbiting scroll 320 and to a contact portion of the orbiting scroll 320 with the fixed scroll 310 while flowing down over the contact portion.

The communication flow path 430 formed in the compressor according to embodiments disclosed herein may not be directly formed in the rotational shaft 400. Rather, after the communication flow path 430 is manufactured as a component independent of the rotational shaft 400, the communication flow path 430 may be coupled with the rotational shaft 400.

Figure 16:
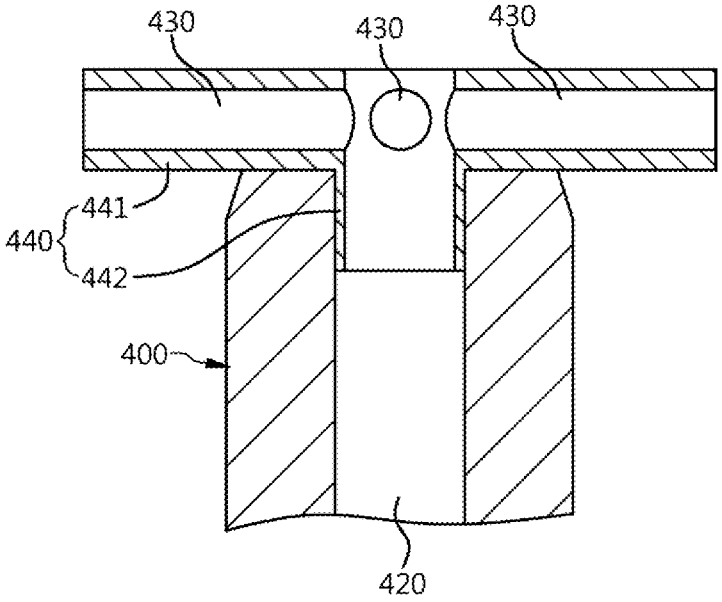
FIG. 16 is a view illustrating another embodiment of the refrigerant discharge pipe of the compressor according to an embodiment.

More particularly, as shown in FIG. 16, the upper end of the refrigerant flow path 420 in the rotational shaft 400 may extend through the upper surface of the rotational shaft 400 and a discharge guide 440 may be provided on the upper surface of the rotational shaft 400. A portion of the discharge guide 440 may be fitted into and coupled with the refrigerant flow path 420 so as to guide a discharge flow of the refrigerant gas to a plurality of positions in the discharge space 101.

The discharge guide 440 may include a body end 441 provided therein to cover the upper surface of the rotational shaft 400 and having a ring shape having an open center, each of the plurality of communication flow paths 430 extending through the body end 441 in the radial direction from the open center to communicate with the open center, and a combination pipe 442 fitted into and coupled with the refrigerant flow path 420 by protruding downward from the open center of the body end 441.

Figure 17:
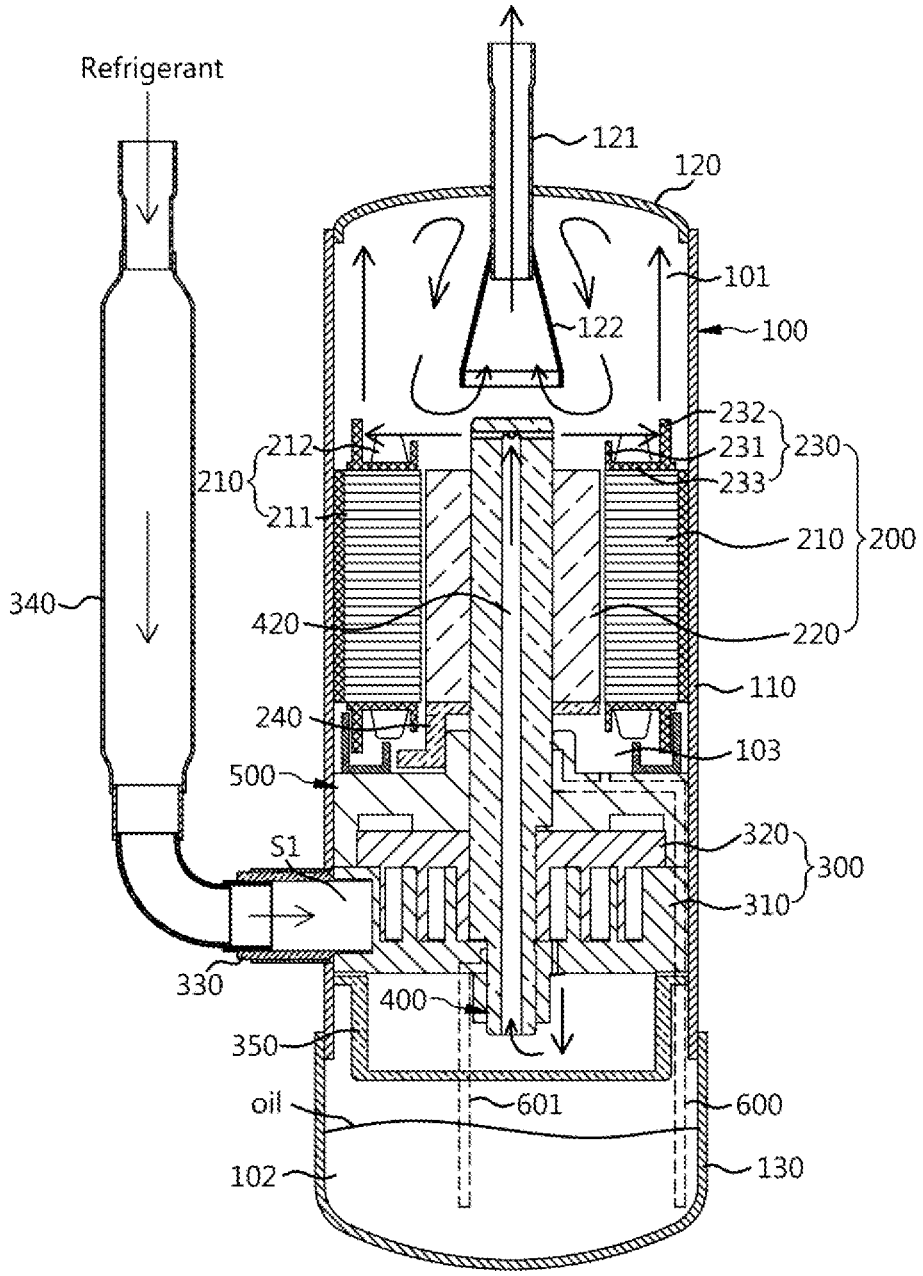
FIG. 17 is a view illustrating another embodiment of a structure of a refrigerant suction side of the refrigerant flow path formed in a rotational shaft of the compressor according to an embodiment.

As shown in FIG. 17, the compressor according to embodiments disclosed herein may further include an enlarged pipe body 122 on a lower end of the refrigerant discharge pipe 121. As an opening of the enlarged pipe body 122 is provided to be enlarged toward a lower portion thereof, the enlarged pipe body 122 may function to separate oil from the refrigerant gas flowing in the discharge space 101. In this case, the refrigerant flow path 420 formed in the rotational shaft 400 may be provided such that the refrigerant gas is discharged in a direction in which the refrigerant flow path 420 does not face the enlarged pipe body 122.

Figure 18:
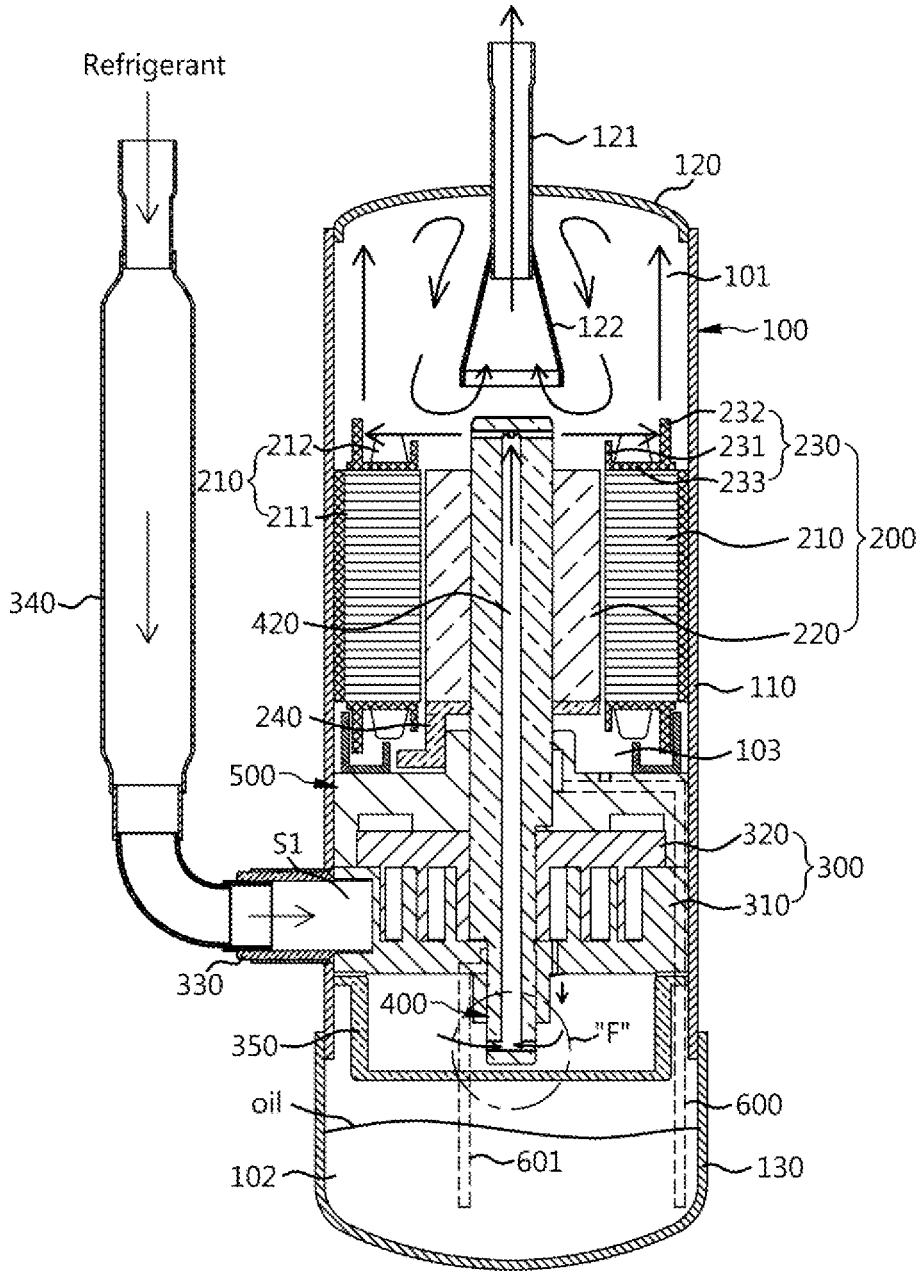
FIG. 18 is a view illustrating another embodiment of an oil supply structure of the compressor according to an embodiment.
Figure 19:
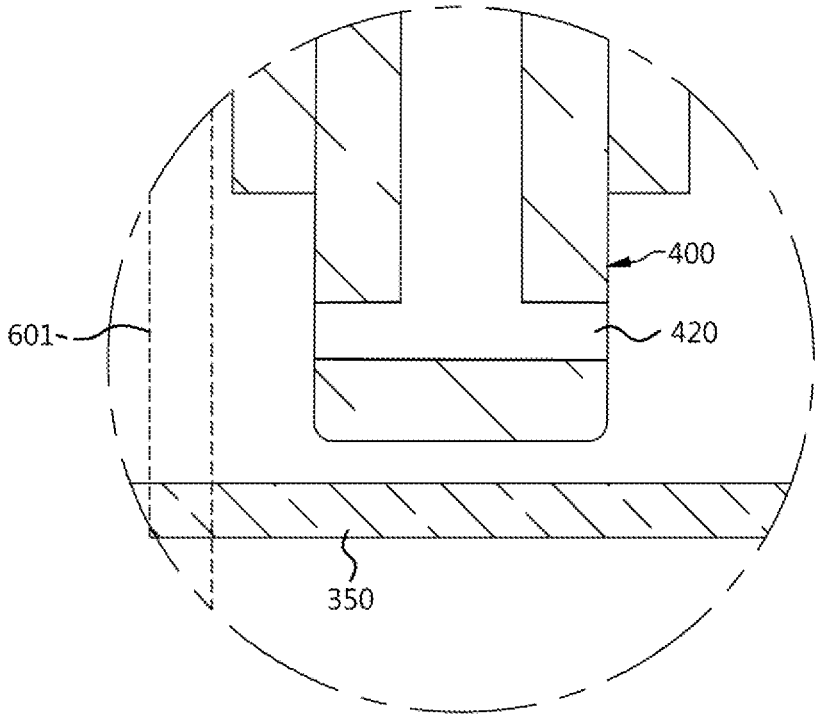
FIG. 19 is an enlarged view of portion "F" of FIG. 18.

A lower end of the refrigerant flow path 420 of the compressor according to embodiments disclosed herein may open to an outer circumferential surface of the rotational shaft 400. This is shown in FIGS. 18 and 19. That is, an open direction of a refrigerant introduction portion of the refrigerant flow path 420, which is described above, may face an open direction of the discharge port 312 so that oil contained in the refrigerant gas discharged through the discharge port 312 is not directly introduced to the refrigerant flow path 420. In addition, when considering that a portion of oil may remain in the discharge cover 350, the oil remaining in the discharge cover 350, which may be introduced into the refrigerant flow path 420 together with the refrigerant gas, may be minimized.

Figure 20:
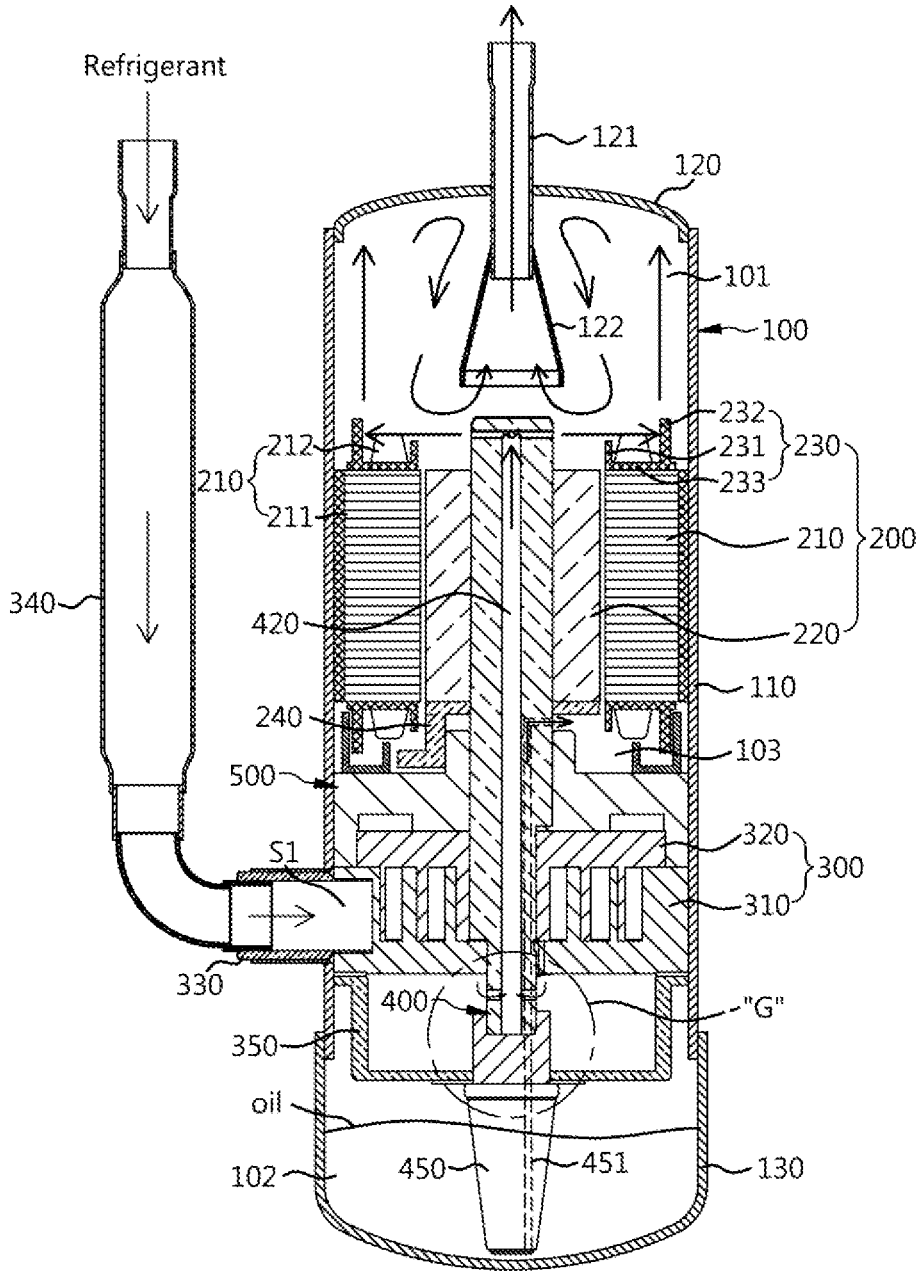
FIG. 20 is a state view illustrating still another embodiment of the oil supply structure of the compressor according to an embodiment.
Figure 21:
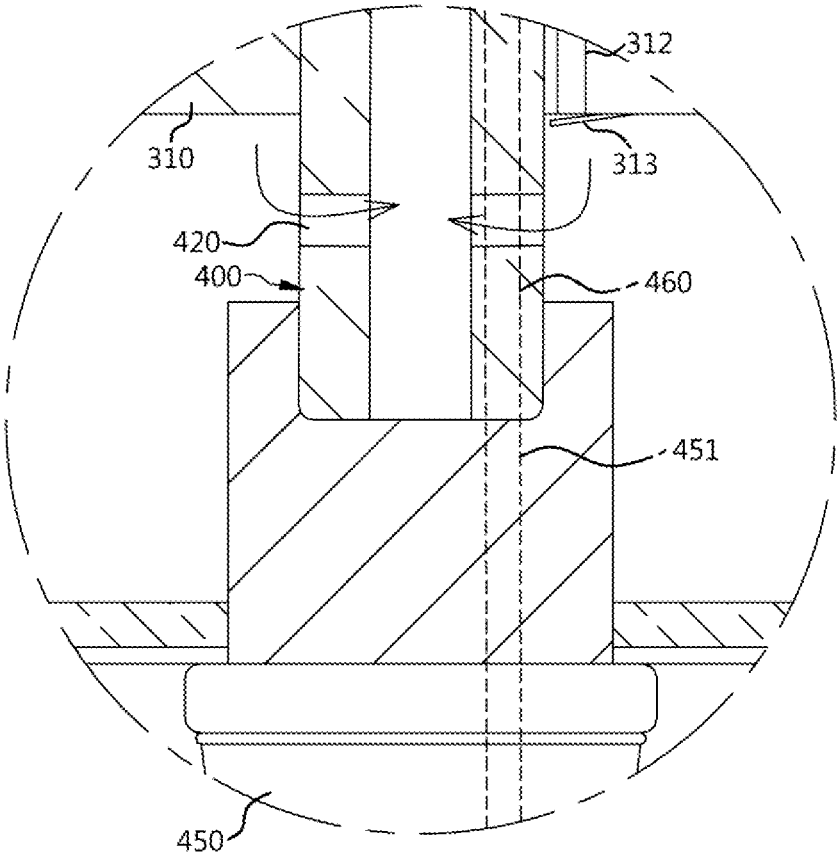
FIG. 21 is an enlarged view of portion "G" of FIG. 20.

Further, an oil feeder 450 having a suction flow path 451 may be provided on or at the lower end of the rotational shaft 400. The oil feeder 450 may extend through a lower surface of the discharge cover 350 so as to be immersed in the oil in the oil storage space 102, and a guide flow path 460 may be further provided in the rotational shaft 400. The guide flow path 460 may receive oil suctioned through the suction flow path 451 of the oil feeder 450 and supply the oil to the sliding portions in the hermetic casing 100. This is shown in FIGS. 20 and 21.

That is, unlike the oil flow path 600 of a pipe type provided in previous embodiments, the guide flow path 460 for suction oil is further provided in the rotational shaft 400. Accordingly, oil supply to the sliding portions may be efficiently performed without modifying structures of the compression device 300 and the main frame 500 to install an additional oil flow path 600. Of course, in this case, a refrigerant introduction portion of the refrigerant flow path 420 formed in the rotational shaft 400 is provided to be open to the circumference of the rotational shaft 400 so as to communicate with the inner space of the discharge cover 350.

Each component of the compressor according to embodiments disclosed herein may be variously modified and various additional effects may be achieved through the various modification.

Accordingly, embodiments have been developed keeping in mind problems occurring in the related art and provide a compressor having a new type of refrigerant guide structure. In a process in which a refrigerant gas discharged into a discharge cover after being compressed in a compression device is guided to a refrigerant discharge space, the refrigerant gas may be maximally prevented from being mixed with oil.

In addition, embodiments provide a compressor having a new type of refrigerant guide structure. That is, refrigerant flow path is provided in a rotational shaft, whereby difficulty of assembling and manufacturing thereof, which may be caused by refrigerant flow paths provided in a fixed scroll and a main frame of the related art, and an inefficient refrigerant flow, which may be caused by disconformity therebetween, may be overcome.

Further, embodiments disclosed herein provide a compressor having a new type of refrigerant guide structure, in which oil supplied to sliding portions is prevented from being mixed with a refrigerant gas flowing to the refrigerant discharge space, whereby a separation guide that separates the refrigerant gas and the oil from each other may be omitted. Furthermore, embodiments disclosed herein provide a compressor having a new type of refrigerant guide structure, in which flow path resistance occurring in a process in which a refrigerant gas discharged into the discharge cover is guided to the discharge space is minimized, whereby an improved performance thereof may be achieved. In addition, embodiments disclosed herein provide a new type of compressor, in which oil stored in an oil storage space in a hermetic casing is supplied to each of sliding portions without passing through the rotational shaft, whereby the refrigerant flow path formed in the rotational shaft may be easily designed.

A compressor according to embodiments disclosed herein may include a refrigerant flow path provided in a rotational shaft to guide refrigerant gas. The rotational shaft may operate a compression device using a drive force of an electric motor. Such a structure allows a compressed refrigerant gas to be directly discharged to a discharge space without passing through other portions so as to minimize flow path resistance.

The compressor according to embodiments disclosed herein may include a hermetic casing having the discharge space to which the refrigerant gas may be discharged. The refrigerant flow path formed in the rotational shaft may be provided so as to guide the refrigerant gas compressed in the compression device to the discharge space. Such a structure allows the compressed refrigerant gas to be directly discharged to the discharge space without passing through other portions so as to minimize flow path resistance.

In the compressor according to embodiments disclosed herein, the discharge space in the hermetic casing may be provided on or at an upper side of an inner space of the hermetic casing; an oil storage space in which oil is stored may be provided on or at a lower side of the inner space of the hermetic casing; and the rotational shaft may extend through a center of each of inner portions of the electric motor and the compression device. An upper end of the rotational shaft may be exposed to the discharge space and a lower end of the rotational shaft may be exposed to a space beneath the compression device. This describes a structure of the refrigerant flow path formed in the rotational shaft applied to a lower compression type compressor.

According to embodiments disclosed herein, the refrigerant flow path formed in the rotational shaft may communicate with each of the discharge space in the hermetic casing and the space beneath the compression device such that the refrigerant gas discharged to the space beneath the compression device may be guided to the discharge space. The compressor according to embodiments disclosed herein may further include a discharge cover provided under the compression device in the hermetic casing, the discharge cover providing a storage space such that the refrigerant gas discharged to the space beneath the compression device after being compressed in the compression device may be stored. The refrigerant flow path formed in the rotational shaft may communicate with an inner space of the discharge cover. In such a structure, the compressed refrigerant gas may be discharged to the inner space of the discharge cover separated from the oil storage space and then may be discharged to the discharge space.

According to embodiments disclosed herein, the refrigerant flow path formed in the rotational shaft may be provided at a position at which the refrigerant flow path does not face a discharge port provided in the compression device. In addition, the lower end of the rotational shaft may be positioned in the discharge cover and the refrigerant flow path may be open at the lower surface of the rotational shaft. Further, the lower end of the rotational shaft may be positioned in the discharge cover and the refrigerant flow path may be open to an outer circumferential surface of the rotational shaft. An open direction of a refrigerant introduction portion of the refrigerant flow path described above may not face an open direction of the discharge port so that oil contained in the refrigerant gas discharged through the discharge port is not directly introduced to the refrigerant flow path.

The compressor according to embodiments disclosed herein may further include an oil feeder on the lower end of the rotational shaft and may further include a guide flow path in the rotational shaft. The guide flow path may receive oil suctioned through a suction flow path of the oil feeder and supply the oil to sliding portions in the hermetic casing. The sliding portions in the hermetic casing may include at least any one portion of an operation portion of the compression device, a portion of the compression device through which the rotational shaft extends, and a portion between the compression device and the electric motor.

The aforementioned structure may include an oil flow path provided in the rotational shaft, and the oil flow path may be separated from the refrigerant flow path.

In the compressor according to embodiments disclosed herein, the upper end of the rotational shaft may be exposed to an inner space of the discharge space of the hermetic casing by extending through the electric motor. A communication flow path may be provided in the rotational shaft, the communication flow path guiding the refrigerant gas such that the refrigerant gas guided to the refrigerant flow path is discharged to the discharge space. In addition, the communication flow path may have at least two communication flow paths. Each of the communication flow paths may be provided in a radial direction from the refrigerant flow path to communicate therewith.

According to the structure of the communication flow path described above, the refrigerant gas discharged to the discharge space may be discharged toward an inner circumferential wall surface of the hermetic casing. In addition, the communication flow path may be rounded, slanted from the refrigerant flow path, or extend in a tangential direction of the refrigerant flow path. In such a structure, the refrigerant gas passing through the communication flow path may have a circulation force.

In the compressor according to embodiments disclosed herein, an upper end of the refrigerant flow path formed in the rotational shaft may extend through an upper surface of the rotational shaft. In addition, a discharge guide may be provided on the upper surface of the rotational shaft so as to guide a discharge flow of the refrigerant gas. Further, the discharge guide may include a body end through which the plurality of communication flow paths are formed and a combination pipe provided as a pipe body having an empty inner space so as to be fitted into and coupled with the refrigerant flow path.

The discharge guide described above may be a structure which allows the communication flow paths to be easily formed and may be coupled with the rotational shaft to be integrated therewith after the discharge guide is manufactured independently of the rotational shaft.

According to the compressor according to embodiments disclosed herein, a refrigerant discharge pipe may be provided in the hermetic casing, and the refrigerant flow path formed in the rotational shaft may be provided such that the refrigerant gas is discharged in a direction in which the refrigerant flow path does not face the refrigerant discharge pipe. Accordingly, oil contained in the refrigerant gas may be prevented from being directly discharged through the refrigerant discharge pipe.

In addition, an enlarged pipe body may be provided in the refrigerant discharge pipe, and the refrigerant flow path formed in the rotational shaft may be provided such that the refrigerant gas is discharged in a direction in which the refrigerant flow path does not face the enlarged pipe body. In the refrigerant gas discharge structure of the refrigerant flow path described above, the refrigerant gas passing through the refrigerant flow path may be prevented from being directly discharged through the refrigerant discharge pipe.

The compressor according to embodiments disclosed herein may further include an oil flow path that allows oil in the oil storage space of the hermetic casing to be supplied to the sliding portions. In addition, the oil flow path may be provided as a pipe. A lower end of the oil flow path may be immersed in the oil in the oil storage space and an upper end thereof may extend through the compression device. According to the structure of the oil flow path described above, the oil flow path may be provided independently of the refrigerant flow path, whereby oil may be minimized from being contained in the refrigerant gas and lubrication and refrigeration may be efficiently performed on each of the sliding portions in the compressor.

As described above, in the compressor according to embodiments disclosed herein, as the refrigerant flow path guiding the refrigerant gas is provided in the rotational shaft, which operates the compression device using the drive force of the electric motor, the refrigerant gas is directly discharged to the discharge space without passing through other portions, whereby flow path resistance is minimized. In addition, the compressor according to embodiments disclosed herein may include the discharge cover that supplies the storage space such that the refrigerant gas, which is compressed in the compression device, discharged to a space beneath the compression device is stored. The refrigerant flow path formed in the rotational shaft may communicate with the inner space of the discharge cover, whereby oil in the oil storage space may be prevented from being mixed with the compressed refrigerant gas.

Further, in the compressor according to embodiments disclosed herein, as the refrigerant flow path provided in the rotational shaft is provided at a position at which the refrigerant flow path is not facing the discharge port provided in the compression part, the oil contained in the refrigerant gas discharged through the discharge port is prevented from being directly introduced to the refrigerant flow path together with the refrigerant gas.

Additionally, in the compressor according to embodiments disclosed herein, as the lower end of the rotational shaft is positioned in the discharge cover and the refrigerant flow path is open to the lower surface of the rotational shaft, the oil contained in the refrigerant gas discharged through the discharge port may be prevented from being directly introduced to the refrigerant flow path together with the refrigerant gas. Also, the compressor according to embodiments disclosed herein may further include the communication flow path provided in the refrigerant flow path of the rotational shaft, whereby the refrigerant gas discharged through the refrigerant flow path to the discharge space may be prevented from being directly discharged through the refrigerant discharge pipe, and accordingly, the oil contained in the refrigerant gas may be prevented from being directly discharged through the refrigerant discharge pipe, together with the refrigerant gas.

Further, in the compressor according to embodiments disclosed herein, the communication flow path is provided to have at least two communication flow paths and each of the communication flow paths is provided in a radial direction from the refrigerant flow path to communicate therewith, whereby the refrigerant gas may be discharged toward the inner circumferential wall surface of the hermetic casing. Accordingly, the oil contained in the refrigerant gas may be prevented from being directly discharged through the refrigerant discharge pipe, together with the refrigerant gas. Furthermore, as the compressor according to embodiments disclosed herein further includes the oil flow path in the hermetic casing, the oil in the oil storage space may be supplied to the sliding portions.

Additionally, according to the compressor according to embodiments disclosed herein, the oil flow path may be a pipe. The lower end of the oil flow path may be immersed in the oil in the oil storage space and the upper end of the oil flow path may extend through the compression device, whereby as the refrigerant flow path is provided along an inner space of the rotational shaft, oil supplied through the oil flow path may be prevented from being mixed with the refrigerant gas flowing along the refrigerant flow path.

In addition, in the compressor according to embodiments disclosed herein, as the refrigerant flow path is formed along the inner space of the rotational shaft, an additional member for separating oil and the refrigerant gas from each other is not required to be provided between the electric motor and a main frame.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present.

As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a hermetic casing having a discharge space to which a refrigerant gas is discharged;

an electric motor provided in the hermetic casing to supply a rotational drive force;

a compression device provided in the hermetic casing so as to compress the refrigerant gas; and a rotational shaft that operates the compression device using the rotational drive force of the electric motor, wherein the rotational shaft includes a refrigerant flow path provided therein, the rotational shaft guiding the compressed refrigerant gas to the discharge space from the compression device, wherein the electric motor is positioned in a lower portion of the discharge space, wherein the compression device is positioned on a lower side of the electric motor, wherein the rotational shaft extends through each of centers of the electric motor and the compression device such that an upper end of the rotational shaft is positioned to be exposed to the discharge space and a lower end of the rotational shaft is positioned to be exposed to a space beneath the compression device, and wherein the refrigerant flow path communicates with the discharge space and the space beneath the compression device such that the refrigerant gas discharged through the space beneath the compression device is guided to the discharge space.

2. The compressor of claim 1, wherein the discharge space in the hermetic casing is provided at an upper side of an inner space of the hermetic casing and an oil storage space in which oil is stored is provided at a lower side of the inner space of the hermetic casing.

3. The compressor of claim 2, further comprising:

a discharge cover provided under the compression device in the hermetic casing, the discharge cover providing a storage space such that the refrigerant gas discharged to a portion positioned under the compression device after being compressed in the compression device is stored, wherein the refrigerant flow path formed in the rotational shaft communicates with an inner space of the discharge cover.

4. The compressor of claim 3, wherein the compression device includes:

a fixed scroll fixed in the inner space of the hermetic casing and having a fixed wrap; and an orbiting scroll having an orbiting wrap engaged with the fixed wrap of the fixed scroll and provided to orbit by receiving a drive force of the rotational shaft, wherein a discharge port is provided in a lower surface of the fixed scroll such that the refrigerant gas compressed between the fixed wrap and the orbiting wrap is discharged into the discharge cover through the discharge port, and wherein the refrigerant flow path formed in the rotational shaft is provided at a position at which the refrigerant flow path does not face the discharge port.

5. The compressor of claim 4, wherein the lower end of the rotational shaft is positioned in the discharge cover and the refrigerant flow path is open at a lower surface of the rotational shaft.

6. The compressor of claim 4, wherein the lower end of the rotational shaft is positioned in the discharge cover and the refrigerant flow path is open at a circumferential surface of the rotational shaft.

7. The compressor of claim 6, further comprising:

an oil feeder provided on the lower end of the rotational shaft, the oil feeder being immersed in oil of the oil storage space by being formed to extend through a lower surface of the discharge cover and having a suction flow path therein, and a guide flow path provided in the rotational shaft, the guide flow path receiving oil suctioned through the suction flow path of the oil feeder and supplying the oil to sliding portions in the hermetic casing.

8. The compressor of claim 7, wherein the sliding portions in the hermetic casing include at least one portion of:

an operation portion of the compression device;

a portion of the compression device through which the rotational shaft extends; and a portion between the compression device and the electric motor.

9. The compressor of claim 2, further comprising:

a communication flow path provided at a portion of the rotational shaft positioned to protrude into the discharge space, the portion being a circumference of the upper end of the rotational shaft, wherein the communication flow path communicates with the refrigerant flow path formed in the rotational shaft such that the refrigerant gas is discharged therethrough.

10. The compressor of claim 9, wherein the communication flow path has at least two communication flow paths, each of the communication flow paths extending in a radial direction from the refrigerant flow path to communicate therewith.

11. The compressor of claim 9, wherein the communication flow path is rounded such that a circulation force is applied to the refrigerant gas passing through the communication flow path.

12. The compressor of claim 9, wherein the communication flow path is slanted from the refrigerant flow path.

13. The compressor of claim 9, wherein the communication flow path extends in a tangential direction of the refrigerant flow path.

14. The compressor of claim 2, wherein an upper end of the refrigerant flow path formed in the rotational shaft is open through an upper surface of the rotational shaft, and wherein a discharge guide is provided on the upper surface of the rotational shaft, a portion of which is fitted into and coupled with the refrigerant flow path so as to guide a discharge flow of the refrigerant gas to a plurality of positions in the discharge space.

15. The compressor of claim 14, wherein the discharge guide includes:

a body end provided therein to cover the upper surface of the rotational shaft and having a ring shape with an open center, wherein each of a plurality of communication flow paths is formed through the body end in a radial direction from the open center to communicate with the open center; and a combination pipe provided as a pipe body having an empty inner space by and protruding downward from the open center of the body end so as to be fitted into and coupled with the refrigerant flow path.

16. The compressor of claim 2, wherein a refrigerant discharge pipe is provided in the hermetic casing and protrudes into the discharge space such that the refrigerant gas is discharged from the discharge space therethrough, and wherein the refrigerant flow path formed in the rotational shaft is configured such that the refrigerant gas is discharged in a direction in which the refrigerant flow path does not face the refrigerant discharge pipe.

17. The compressor of claim 16, wherein the refrigerant discharge pipe is positioned in the discharge space and extends through a center of an upper surface of the hermetic casing, wherein an enlarged pipe body is provided on a lower end of the refrigerant discharge pipe, an opening of which is gradually enlarged toward a lower portion of the enlarged pipe body, and wherein the refrigerant flow path formed in the rotational shaft is configured such that the refrigerant gas is discharged in a direction in which the refrigerant flow path does not face an open portion of the enlarged pipe body.

18. The compressor of claim 2, wherein an oil flow path through which oil in the oil storage space is supplied to sliding portions is provided in the hermetic casing.

19. The compressor of claim 18, wherein the oil flow path comprises a pipe, a lower end of which is immersed in the oil in the oil storage space and an upper end of which extends through the compression device into a space positioned between the compression device and the electric motor.

20. A compressor, comprising:

a hermetic casing having a discharge space;

a compression device including a fixed scroll and an orbiting scroll provided in the hermetic casing so as to compress a refrigerant gas, a compression chamber in which the refrigerant gas is compressed being formed between the fixed scroll and the orbiting scroll by an orbiting motion of the orbiting scroll with respect to the fixed scroll, a discharge port being formed in the fixed scroll;

an electric motor provided in the hermetic casing to supply a rotational drive force;

a rotational shaft that rotates the orbiting scroll using the rotational drive force of the electric motor, wherein the rotational shaft includes a refrigerant flow path provided therein; and a discharge cover provided below the compression device, wherein the compressed refrigerant gas is discharged through the discharge port into the discharge cover and is guided to the discharge space through the refrigerant flow path provided in the rotational shaft, wherein the electric motor is positioned in a lower portion of the discharge space, wherein the compression device is positioned on a lower side of the electric motor, wherein the rotational shaft extends through each of centers of the electric motor and the compression device such that an upper end of the rotational shaft is positioned to be exposed to the discharge space and a lower end of the rotational shaft is positioned to be exposed to a space beneath the compression device, and wherein the refrigerant flow path communicates with the discharge space and the space beneath the compression device such that the refrigerant gas discharged through the space beneath the compression device is guided to the discharge space.

21. A compressor, comprising:

a hermetic casing having a discharge space;

a compression device including a fixed scroll and an orbiting scroll provided in the hermetic casing so as to compress a refrigerant gas, a compression chamber in which the refrigerant gas is compressed being formed between the fixed scroll and the orbiting scroll by an orbiting motion of the orbiting scroll with respect to the fixed scroll, a discharge port being formed in the fixed scroll;

an electric motor provided in the hermetic casing to supply a rotational drive force; and a rotational shaft that rotates the orbiting scroll using the rotational drive force of the electric motor, wherein the rotational shaft includes a refrigerant flow path provided therein, wherein the compressed refrigerant gas is discharged through the discharge port into a space below the compression device and is guided to the discharge space through the refrigerant flow path provided in the rotational shaft, and wherein the compressed refrigerant gas is discharged from the refrigerant flow path into the discharge space in a radial direction, wherein the electric motor is positioned in a lower portion of the discharge space, wherein the compression device is positioned on a lower side of the electric motor, wherein the rotational shaft extends through each of centers of the electric motor and the compression device such that an upper end of the rotational shaft is positioned to be exposed to the discharge space and a lower end of the rotational shaft is positioned to be exposed to a space beneath the compression device, and wherein the refrigerant flow path communicates with the discharge space and the space beneath the compression device such that the refrigerant gas discharged through the space beneath the compression device is guided to the discharge space.

* * * * *